US006893278B2

(12) United States Patent
Ohsawa

(10) Patent No.: US 6,893,278 B2
(45) Date of Patent: May 17, 2005

(54) CONNECTOR FOR CONNECTING WITH FLEXIBLE SUBSTRATES

(75) Inventor: Fumio Ohsawa, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/278,006

(22) Filed: Oct. 22, 2002

(65) Prior Publication Data

US 2003/0134533 A1 Jul. 17, 2003

(30) Foreign Application Priority Data

Jan. 16, 2002 (JP) ..... 2002-007766

(51) Int. Cl.[7] ..... H01R 13/15; H01R 12/24
(52) U.S. Cl. ..... 439/260; 439/495
(58) Field of Search ..... 439/260, 495, 439/496, 329, 342, 157, 607, 326, 499

(56) References Cited

U.S. PATENT DOCUMENTS 5,997,321 A * 12/1999 Nakata et al. ..... 439/157
6,241,540 B1 * 6/2001 Tokuwa ..... 439/157
6,319,052 B1 * 11/2001 Chang ..... 439/495

FOREIGN PATENT DOCUMENTS

JP 2002-175848 A1 6/2002

* cited by examiner

*Primary Examiner*—Tho D. Ta
*Assistant Examiner*—Felix O. Figueroa
(74) *Attorney, Agent, or Firm*—Darby & Darby

(57) ABSTRACT

A connector for connecting to a flexible substrate which includes reinforcement for the surrounding areas of the pivot-supporting holes which support an operation lever and provides feedback to an operator when the operation lever is locked to the housing of the connector. A slider is directed by guides while the operation lever turns. When the slider is at a backward position, an insertion opening can be accessed for inserting a flexible substrate. When the slider is at a forward position, a press plate of the slider presses either one of the flexible substrate which has been inserted into the opening and the contacts provided in the housing to the other one. An electrical connection is established between the flexible substrate and the contacts. The operation lever is parallel to the slider in the forward position, and locks provided on a side surface opposite to the side surface with the insertion opening are locked to turn locks on the operation lever. The guides are fixed to the housing and are formed by bending a metal plate into a U shape. The pivot-supporting holes are formed individually on the guides.

2 Claims, 12 Drawing Sheets

CONNECTOR FOR CONNECTING WITH FLEXIBLE SUBSTRATES

FIELD OF THE INVENTION

The present invention relates to a connector for electrically connecting flexible substrates such as flexible flat cables (FFC) and flexible printed circuit boards (FPC), to printed circuit boards. These flexible substrates have multiple contact terminals exposed on a flexible flat edge.

BACKGROUND OF THE INVENTION

A conventional connector is fixed on a printed circuit board and connects a printed circuit board to a flexible substrate such as a FFC or FPC. The connector has a zero insertion force (ZIF) structure that is useful for bendable, flexible substrates. The flexible substrate can be inserted into the connector with a low insertion force without sustaining contact pressure from the contacts of the connector. After the flexible substrate is inserted into the connector, contact pressure is placed on the flexible substrate by the contacts of the connector to provide a stable electrical connection.

Japanese Patent Application No. 2000-372875 for "CONNECTOR FOR CONNECTING WITH FLEXIBLE SUBSTRATES" (hereinafter "JP '875"), which is incorporated herein by reference in its entirety, discloses a conventional ZIF connector for connecting flexible substrates to printed circuit boards.

The ZIF structure of a conventional connector 101 is shown in FIG. 11. An end of a flexible substrate 120 is inserted into a recessed insertion opening 107 in a housing 102 of the connector 101. Contacts 105, 106 are fixed at predetermined intervals in housing 102 and include contact points 105*a*, 106*a*, respectively. The contact points 105*a*, 106*a* face each other and contact the corresponding conductor patterns on the flexible substrate 120 during insertion of the flexible substrate 120 into the insertion opening 107.

A slider 103 moves freely between a backward position and a forward position during operation of the connector 101. The slider 103 is in the backward position when it has been pulled out from the insertion opening 107, and a resulting gap allows for the insertion of the flexible substrate 120 into the insertion opening 107. The slider 103 is in the forward position when it is secured to the housing 102. When the slider is in the forward position, the flexible substrate 120 is inserted into the insertion opening 107 and can contact either contact points 105*a* or 106*a* elastically. An insertion slot is located on the bottom side of slider 103 and allows the flexible substrate 120 to be inserted into the insertion opening 107.

A sliding slot 111 on each side of the housing 102 engages with tabs that are located on the sides of the slider 103 and prevents the slider 103 from separating from the housing 102 during operation.

A pressure plate 108 extends outward from the slider 103. When the slider 103 is in the forward position, the pressure plate 108 elastically pushes the end of the flexible substrate into electrical contact with the contacts 105, 106.

An operational lever 104 is supported to rotate with respect to the housing 102 on pivots 112 that extend from turn arms 110. The pivots engage loosely with the pivot-supporting holes 113 that are located on the housing 102. Cam surfaces 115, 116 provided on the operational lever 104 engage with respective follower surfaces on the slider 103 and allow the slider 103 to move between the forward and the backward positions. The slider 103 switches between these two positions by operating the operational lever 104.

The contacts 105, 106 are positioned in a staggered pattern in the housing 102. The contact points 105*a*, 106*a* align within the insertion opening 107 along a front and a rear row, respectively.

In JP '875, an operational space on both sides of the housing 102 is unnecessary since the operational lever 104 can turn without blocking the flexible substrate 120.

The thickness of the pressure plate 108 on the slider 103 may be adjusted to allow the flexible substrate 120 to connect elastically with the contacts 105, 106 under sufficient pressure.

The operational lever 104 is prevented from turning unintentionally since it can be locked to the housing 102. Furthermore, unintentional extraction of the flexible substrate 120 can be prevented by the slider 103.

The cam surfaces 115, 116 may be machined easily since the operation lever 104 and the slider 103 interact simply by bringing the cam surfaces 115, 116 in contact with the slider 103. Additionally, a small force is required to turn the operation lever 104 and move the slider 103 since the cam surfaces 115, 116 are adjacent to the rotation center of the operation lever 104.

JP '875 provides an appropriate size of the connector in order to support the operation lever, sufficient contact pressure between the contacts and the flexible substrate, and a stopper to prevent unintentional turning of the operation lever.

However, the area surrounding the pivot-supporting holes 113 is too weak for a small connector 101. The operation lever 104 turns by means of pivots which protrude from turn arms of the operation lever 104. The pivots are loosely engaged in the pivot-supporting holes 113 provided on the housing 102. When the operation lever 104 is mishandled, the areas surrounding the pivot-supporting holes 113 break, and the connector 101 becomes inoperable.

The operation lever 104 turns when the flexible substrate 120 is mounted on the connector 101, and the contacts 105, 106 contact the flexible substrate 120. However, there is no feedback to the operator to indicate when the operation lever 104 has turned or when the operation lever 104 is parallel with the top surface of the housing 102.

Furthermore, vibration may cause the operation lever 104 to release the flexible substrate 120 from the contacts 105, 106, thereby risking a loss of electrical contact since the operation lever 104 is not secured at the position where it is parallel to the housing 102.

SUMMARY OF THE INVENTION

The present invention provides a connector for connecting flexible substrates to printed circuit boards. The connector comprises a housing, multiple contacts, a slider, and an operation lever. The housing includes a pair of side surfaces that face each other, pivot-supporting holes on the side surfaces, L-shaped guides bending outward from the side surfaces, guide grooves on a surface of the guides, a recessed insertion opening for inserting a flexible substrate through a third side surface that does not have pivot-supporting holes, and locks on a fourth side surface opposite the third side surface which includes the insertion opening. The multiple contacts on the housing include contact points arranged at predetermined intervals in the insertion opening. The multiple contacts contact conductor patterns on the flexible substrate.

The slider is U-shaped and includes slide arms and a press plate. The slide arms face each other and are guided by the guides in the housing. The press plate is located inside the U shape on a part other than the slide arms and is inserted into the insertion opening.

The slider travels freely between a backward position and a forward position. The backward position is the position where the press plate is pulled out from the insertion opening so that there is a gap for inserting the flexible substrate into the insertion opening. The forward position is the position where the press plate and the flexible substrate are inserted into the insertion opening and either one of the contact points of the contacts and the conductor patterns of the flexible substrate are pressed against the other one.

The operation lever includes turn arms that face each other. Pivots protrude from the turn arms and are engaged turnably with the pivot-supporting holes on the guides. An operation part connects the turn arms and includes turn locks for locking with the locks on the housing. The operation lever is supported by the housing and turns in order to move the slider forward and backward in association with the turn. When the operation lever is turned, guide protrusions on the slider slide in the guide grooves of the guides to move the slider between the forward position and the backward position. When the slider moves to the forward position, the turn locks on the operation lever are locked to the locks on the housing.

The connector can comprise guides in addition to the housing, multiple contacts, the slider, and the operation lever. The guides are formed in a U-shape section with a plate, preferably of metal, and include a pivot-supporting hole provided through one of surfaces that face each other and an oblong hole through the other surface serving as a guide groove. The housing includes a pair of side surfaces for fixing the surface of the guides and another side surface for an insertion opening which is recessed to insert a flexible substrate. The multiple contacts attached to the housing include contact points arranged at predetermined intervals in the insertion opening. The multiple contacts come in contact with conductor patterns on the flexible substrate. The slider is U-shaped and includes slide arms and a press plate. The slide arms are positioned facing each other and are guided by the guides in the housing. The press plate is located inside the U shape on a part other than the slide arms and is inserted into the insertion opening.

The slider travels freely between a backward position and a forward position. The backward position is the position where the press plate is pulled out from the insertion opening so that there is a gap for inserting the flexible substrate into the insertion opening. The forward position is the position where the press plate and the flexible substrate are inserted into the insertion opening and either one of the contact points of the contacts and the conductor patterns of the flexible substrate are pressed against the other.

The operation lever includes turn arms that face each other and pivots which protrude from the turn arms and are engaged turnably with the pivot-supporting holes on the guides. The operation lever is supported turnably by the housing and moves the slider forward and backward in association with the turn. Guide protrusions on the slider slide between the forward position and the backward position in the guide grooves of the guides when the operation lever is turned. When the slider is in the backward position, the flexible substrate can be inserted into the insertion opening. When the slider moves to the forward position, the contact points of the multiple contacts come into contact with the conductor patterns of the flexible substrate which is inserted elastically into the insertion opening while the turn locks on the operation lever are locked to the locks on the housing.

The operation lever is connected to the pivot-supporting holes of the housing in order to turn in the direction associated with moving the slider into the forward position. The slider moves along the guides provided in the housing to the forward position while the press plate is inserted into the insertion opening of the housing. As the slider moves, the guide protrusions provided on the slide arms of the slider are locked to the guide grooves provided through the guides of the housing.

When the press plate on the slider enters the insertion opening, the press plate will press either one of the contact points of the contacts provided in the housing or the flexible substrate against the other. The slider is in the forward position when the operation lever reaches a limit for turning and the press plate on the slider pushes the flexible substrate into contact electrically with the contacts.

The locks provided on the housing and on the operation lever can be locked when the operation lever is turned to the limit toward the side of the housing. Therefore, the slider can be locked at the forward position, and the flexible substrate can be securely connected electrically to the contacts.

The metal guides which are fixed to the housing reinforce the pivot-supporting holes. Therefore, the pivot-supporting holes can withstand rough treatment from continuous operation or excessive force.

The operation lever is turned when the flexible substrate is extracted from the connector so that the slider can move to the backward position. The press plate on the slider releases the pressure on the flexible substrate so that the contact points of the contacts are no longer in contact with the flexible substrate in the insertion opening. Therefore, the releasing operation can be completed by extracting the flexible substrate which can be inserted into or extracted from the insertion opening freely.

The present invention provides a connector for securely and electrically connecting flexible substrates with advantages over the prior art. The present connector applies zero insertion force (ZIF) on the flexible substrate during insertion into the connector and provides a uniform elastic contact pressure between the flexible substrate and a set of electrical contacts. The flexible substrate can be easily manipulated to electrically engage with a set of electrical contacts. The locking mechanism is reliable, can be easily manipulated, prevents the unintentional release of the flexible substrate, and prevents damage to the flexible substrate during insertion and retention. The connector device resists breakage at pivot points and is durable under continued operation and abuse. The unitary release of elastic contact pressure on the flexible substrate prevents damage to the flexible substrate and the set of contacts. Furthermore, the connector device allows easy insertion and extraction of a flexible substrate by operation of single releasable locking lever.

The features and advantages of the present invention will become apparent from the following description with reference to the accompanying drawings.

BRIEF DESCRIPTION OF THE DRAWINGS

FIG. 1(*b*) is a front view of a connector of the present invention in a forward position.

FIG. 1(*c*) is a left side view of a connector of the present invention in a forward position.

FIG. 1(*d*) is a left side view of a connector of the present invention in a backward position.

FIG. 1(*e*) is a sectional view along line 1(*e*)—1(*e*) of FIG. 1(*a*) of a connector of the present invention in a forward position.

FIG. 1(*f*) is a sectional view along line 1(*e*)—1(*e*) of FIG. 1(*a*) of a connector of the present invention in a backward position.

FIG. 2(*b*) is a perspective view of a connector of the present invention in a backward position.

FIG. 3(*b*) is a front view of a housing of the present invention.

FIG. 3(*c*) is a bottom view of a housing of the present invention.

FIG. 3(*d*) is a left side view of a housing of the present invention.

FIG. 3(*e*) is a longitudinal sectional view at the center of a housing of FIG. 3(*b*).

FIG. 4(*b*) is a plan view of a guide of the present invention.

FIG. 4(*c*) is a front view of a guide of the present invention.

FIG. 4(*c*) is a front view of a guide of the present invention.

FIG. 4(*d*) is a right side view of a guide of the present invention.

FIG. 5(*b*) is a front view of a slider of the present invention.

FIG. 5(*c*) is a bottom view of a slider of the present invention.

FIG. 5(*d*) is a left side view of a slider of the present invention.

FIG. 5(*e*) is a sectional view of the right slide arm in FIG. 5(*a*).

FIG. 5(*f*) is a sectional view of the slider body in FIG. 5(*a*).

FIG. 6(*b*) is a front view of an operation lever of the present invention.

FIG. 6(*c*) is a bottom view of an operation lever of the present invention.

FIG. 6(*d*) is a right side view of an operation lever of the present invention.

FIG. 6(*e*) is a longitudinal sectional view at the center of an operation lever in FIG. 6(*a*).

FIG. 8(*b*) is a partial perspective view of a locked state of a connector of the present invention.

DETAILED DESCRIPTION OF THE PREFERRED EMBODIMENTS

Figure 1A:
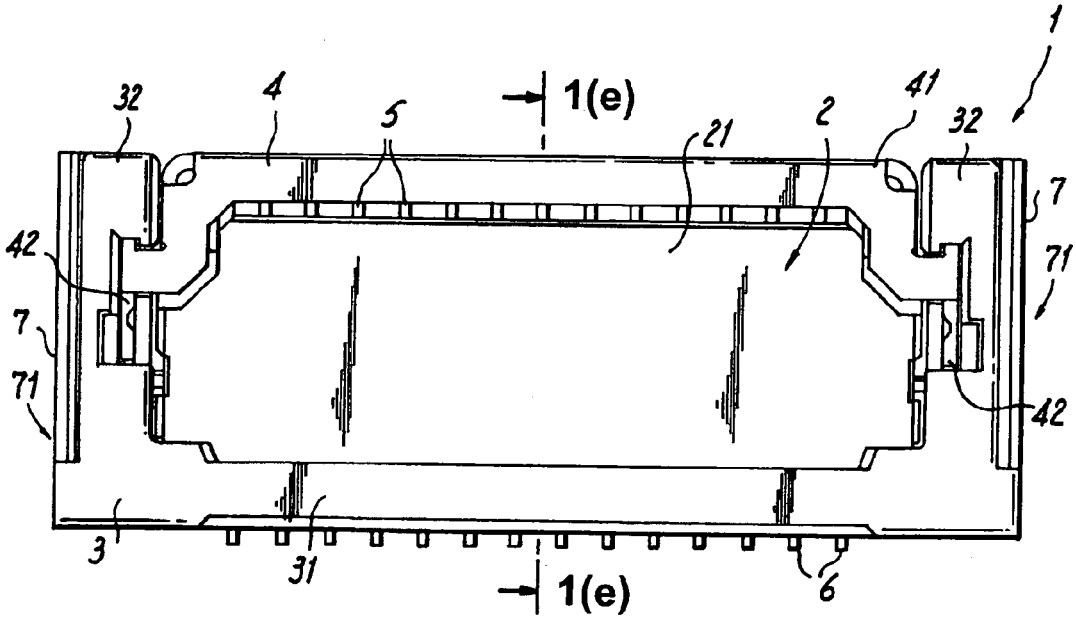
FIG. 1(*a*) is a plan view of a connector of the present invention in a forward position.
Figure 1B:
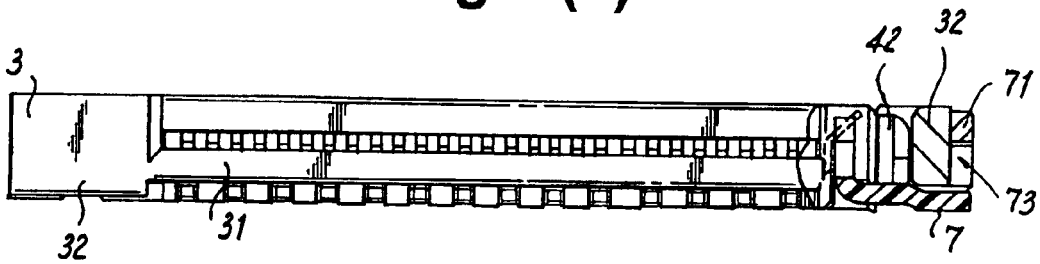
Figure 1C:
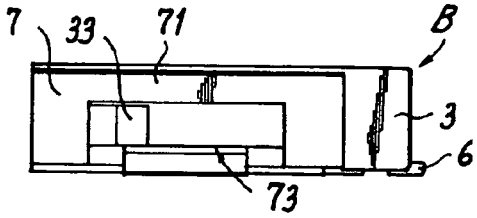
Figure 1D:
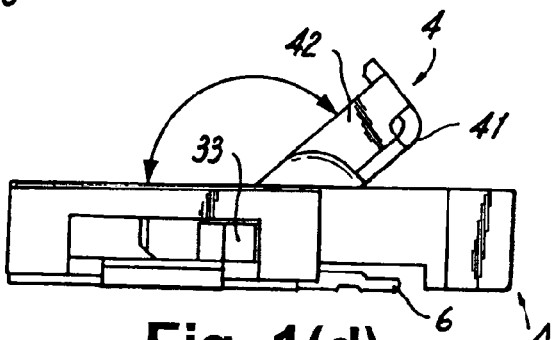
Figure 1E:
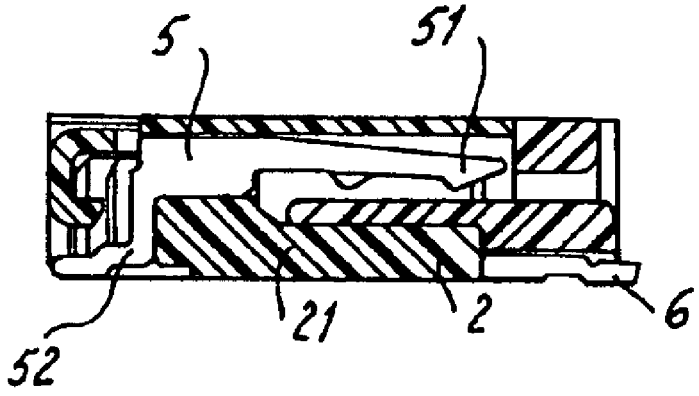
Figure 1F:
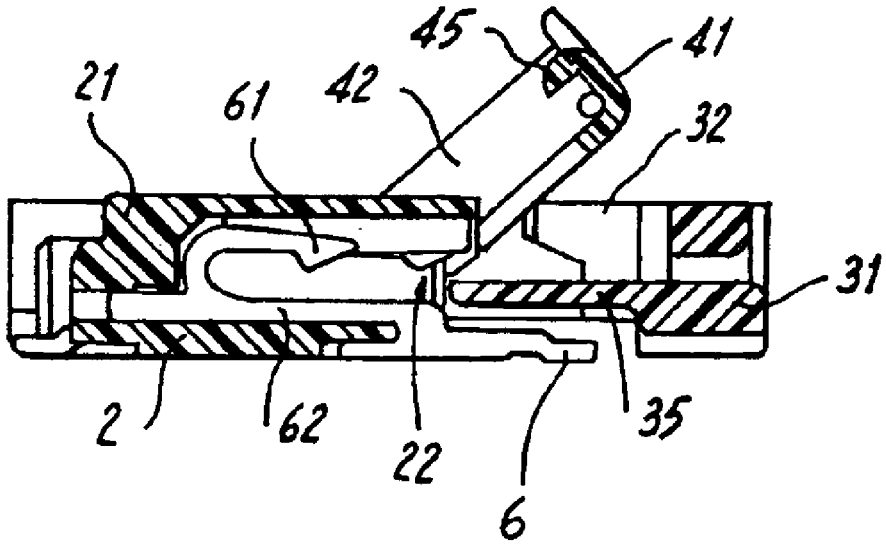
Figure 2A:
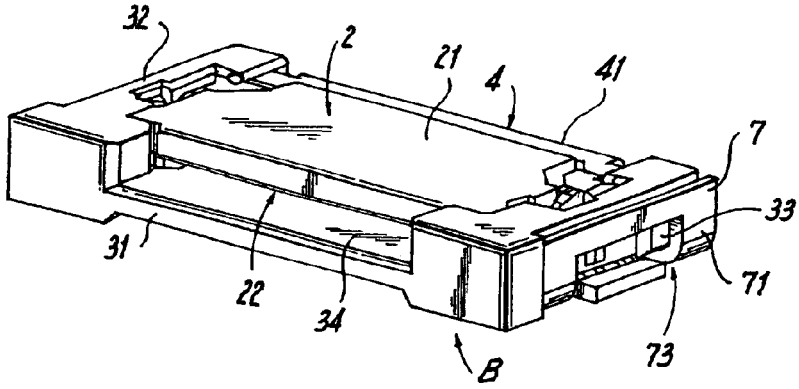
FIG. 2(*a*) is a perspective view of a connector of the present invention in a forward position.
Figure 2B:
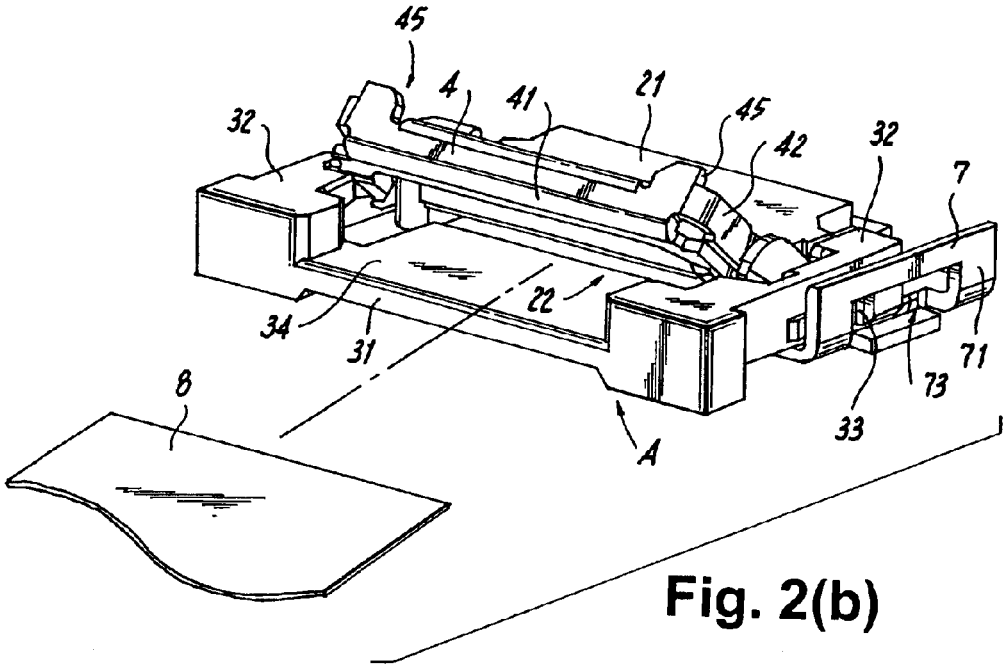
Figure 3A:
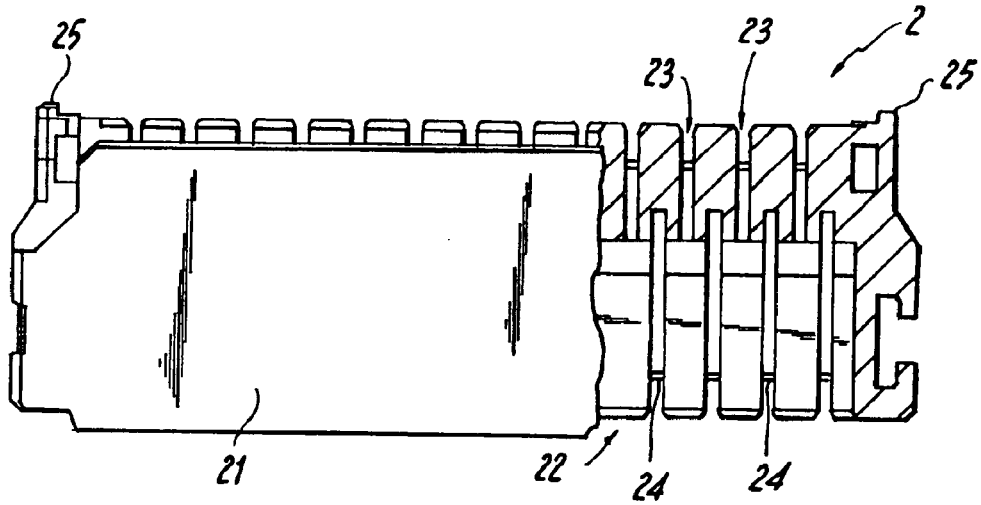
FIG. 3(*a*) is a plan view of a housing of the present invention.
Figure 3B:
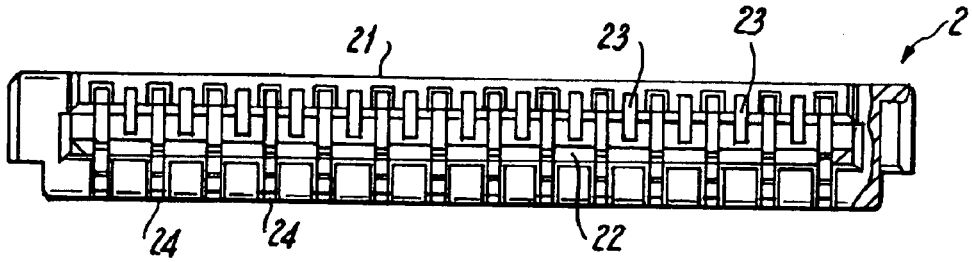
Figure 3C:
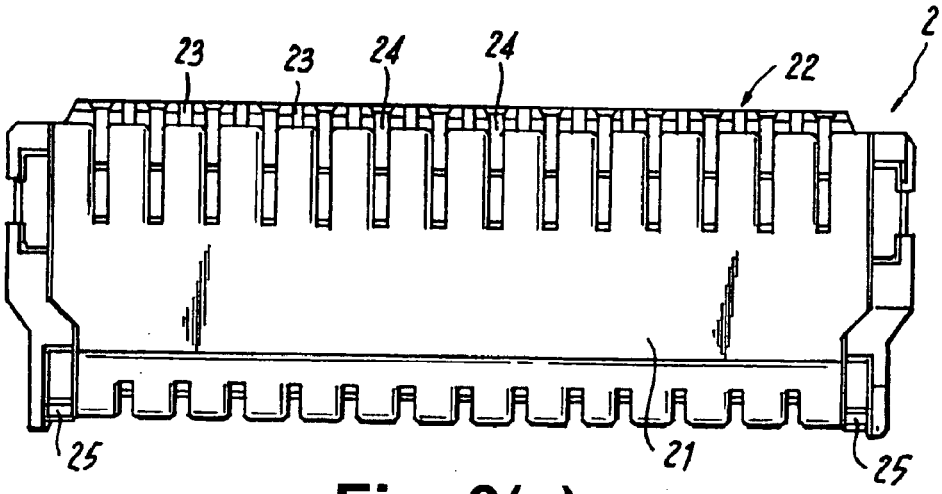
Figure 3D:
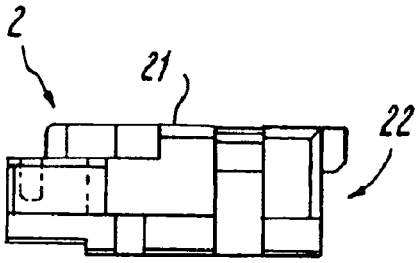
Figure 3E:
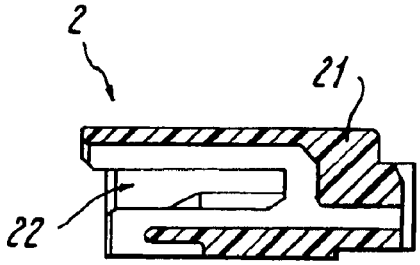
Figure 4A:
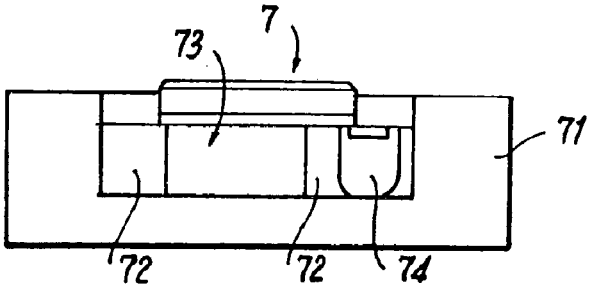
FIG. 4(*a*) is a left side view of a guide of the present invention.
Figure 4B:
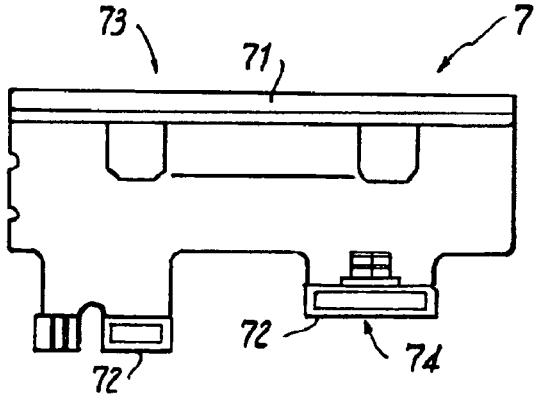
Figure 4C:
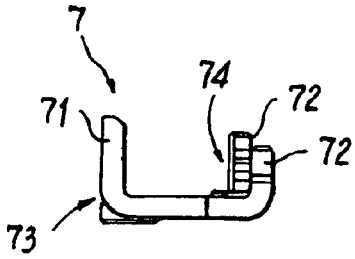
Figure 4D:
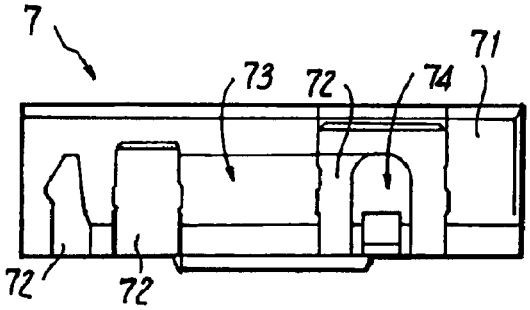
Figure 5A:
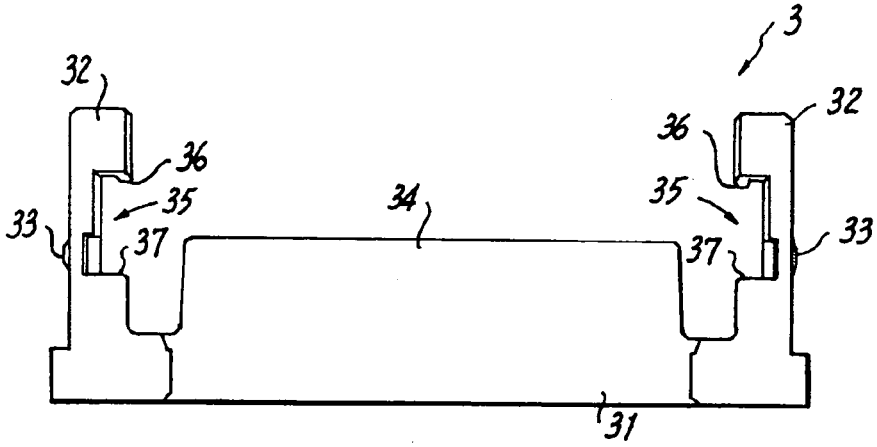
FIG. 5(*a*) is a plan view of a slider of the present invention.
Figure 5B:
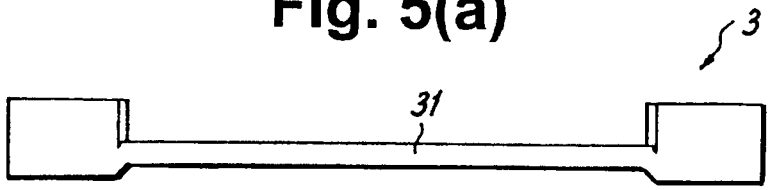
Figure 5C:
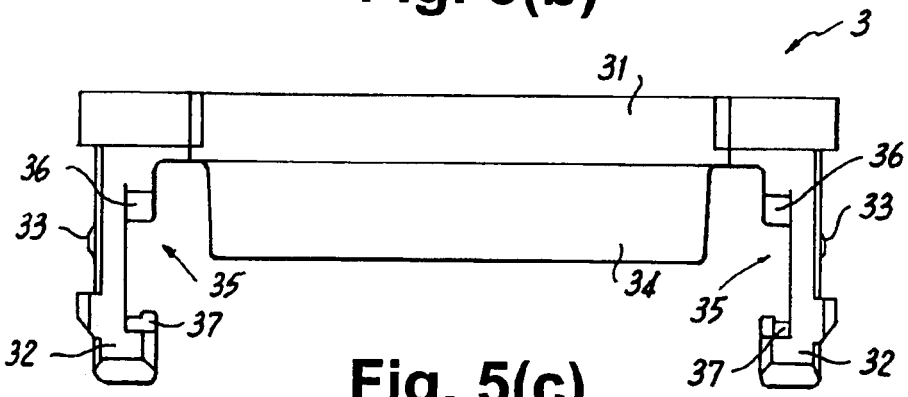
Figure 5D:
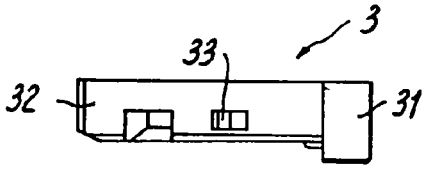
Figure 5E:
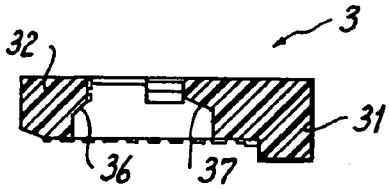
Figure 5F:
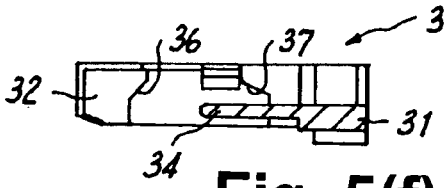
Figure 6A:
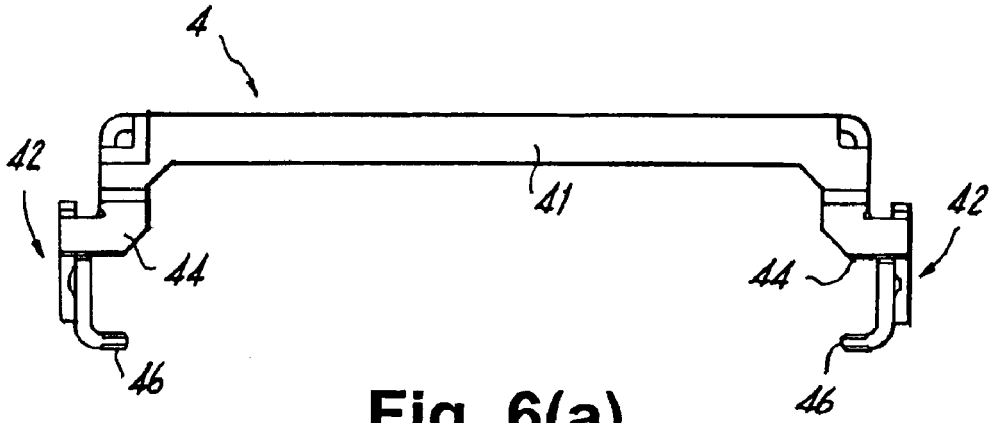
FIG. 6(*a*) is a plan view of an operation lever of the present invention.
Figure 6B:
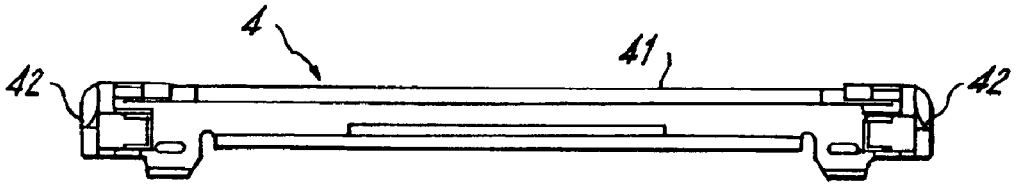
Figure 6C:
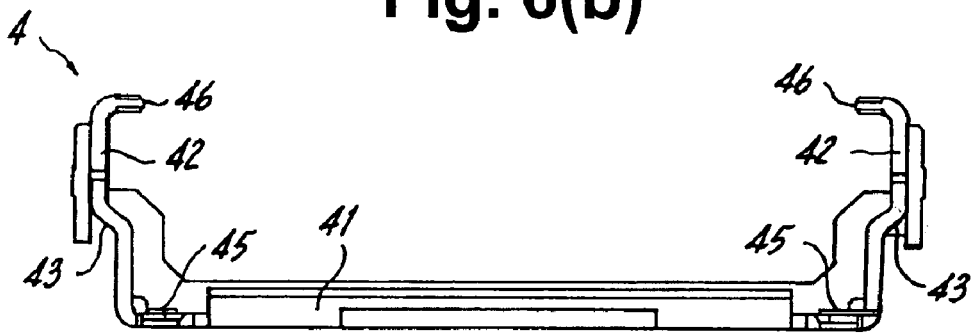
Figure 6D:
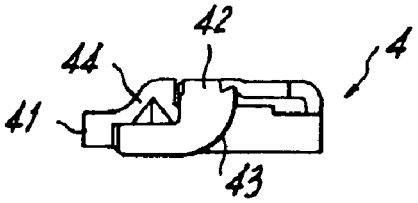
Figure 6E:
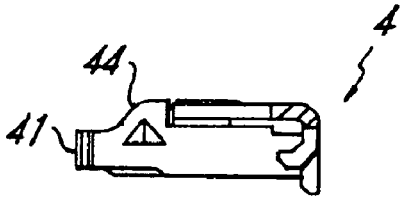
Figure 7A:
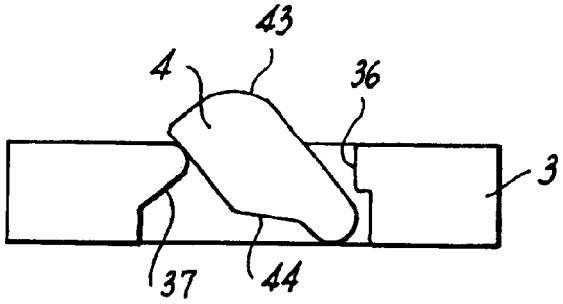
FIGS. 7(*a*)–(*e*) are descriptive views of sequential states of a slider of the present invention in operation while the operation lever turns.
Figure 7B:
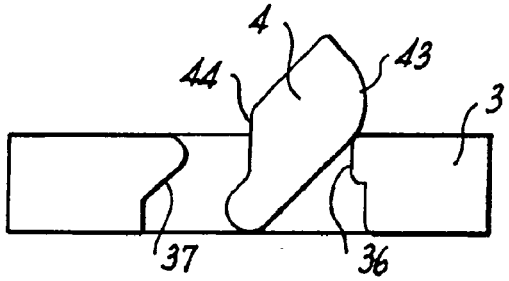
Figure 7C:
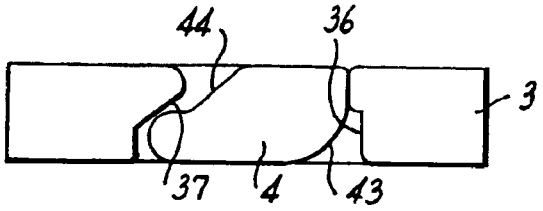
Figure 7D:
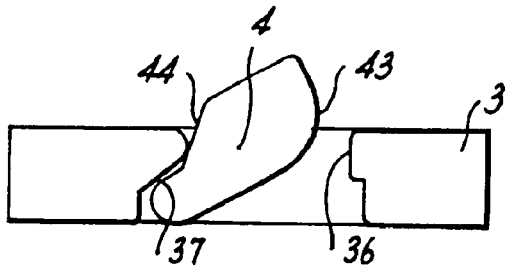
Figure 7E:
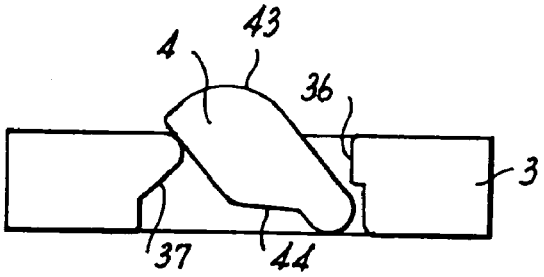
Figure 8A:
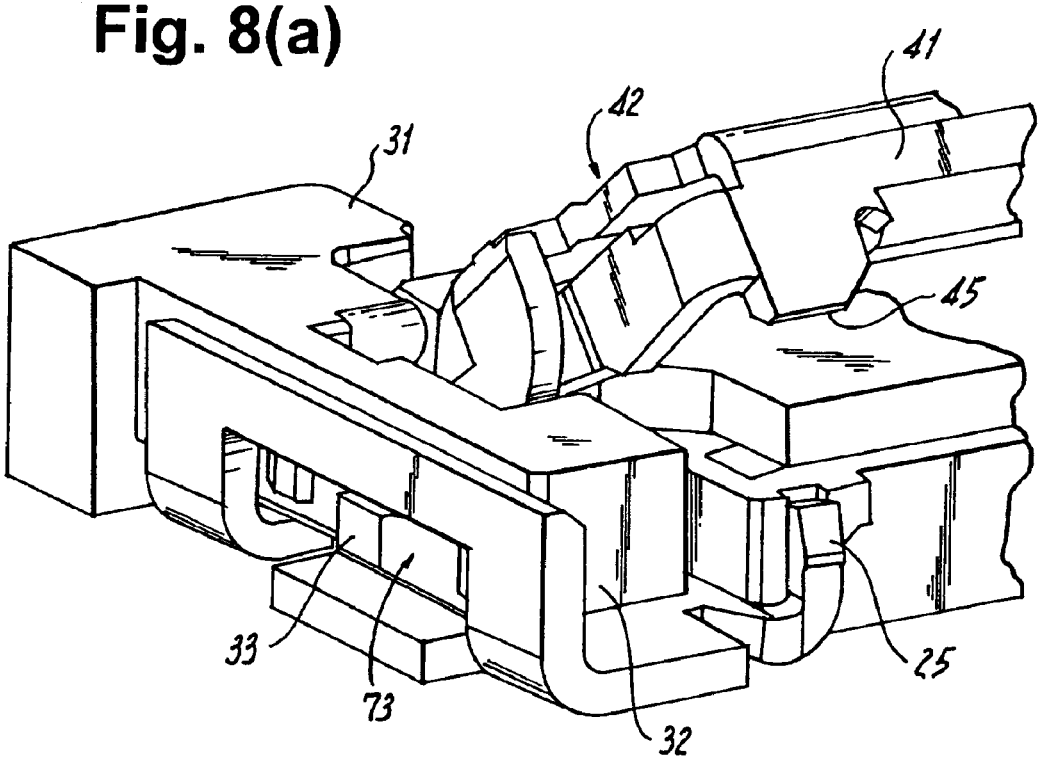
FIG. 8(*a*) is a partial perspective view of an unlocked state of a connector of the present invention.
Figure 8B:
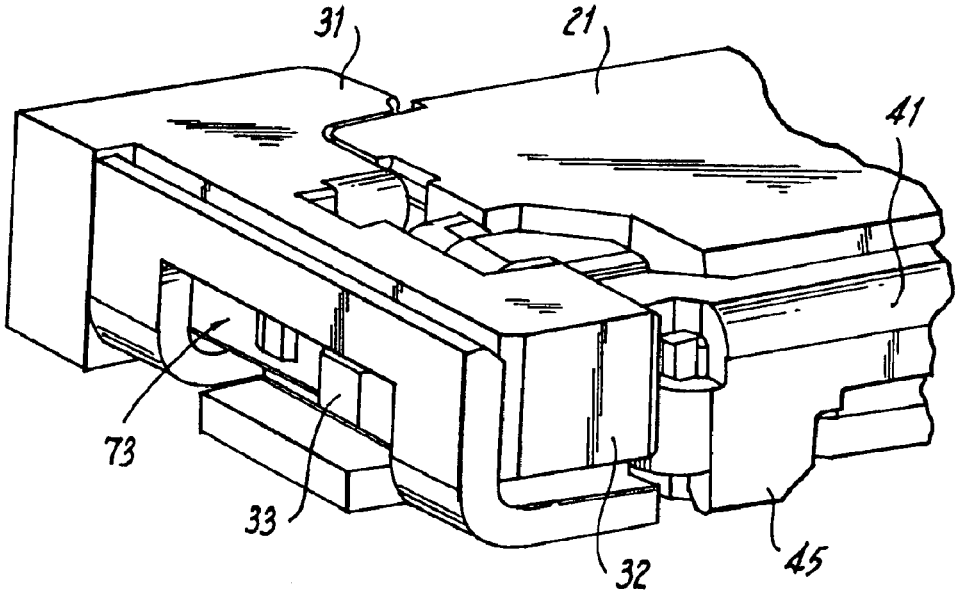
Figure 9:
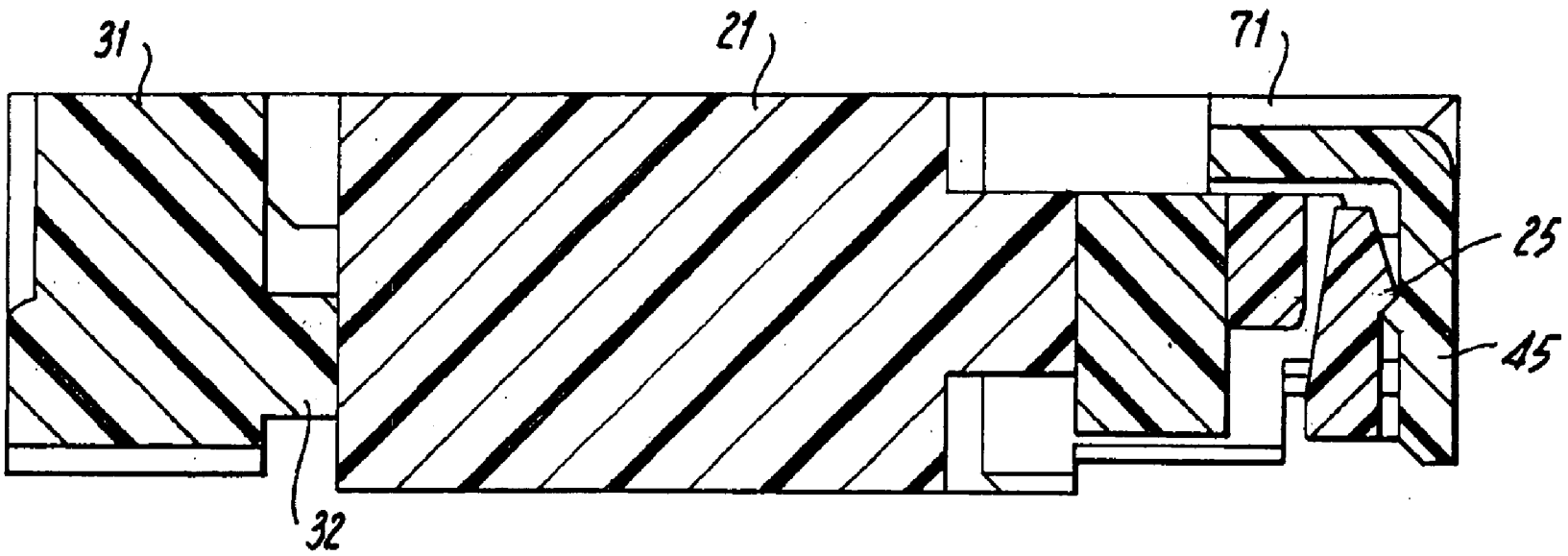
FIG. 9 is a sectional view of an operation lever of the present invention that is locked to a housing.
Figure 10:
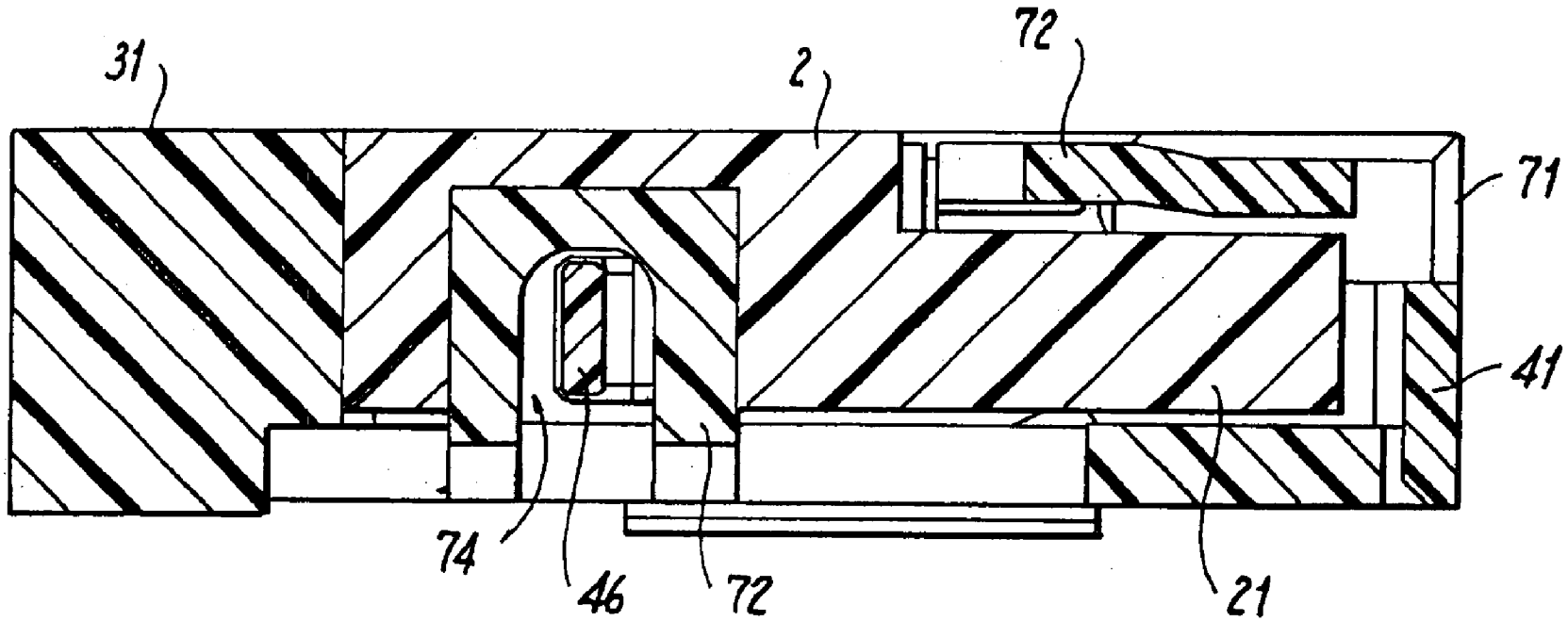
FIG. 10 is a sectional view of an operation lever of the present invention that is loosely engaged with the guides.
Figure 11:
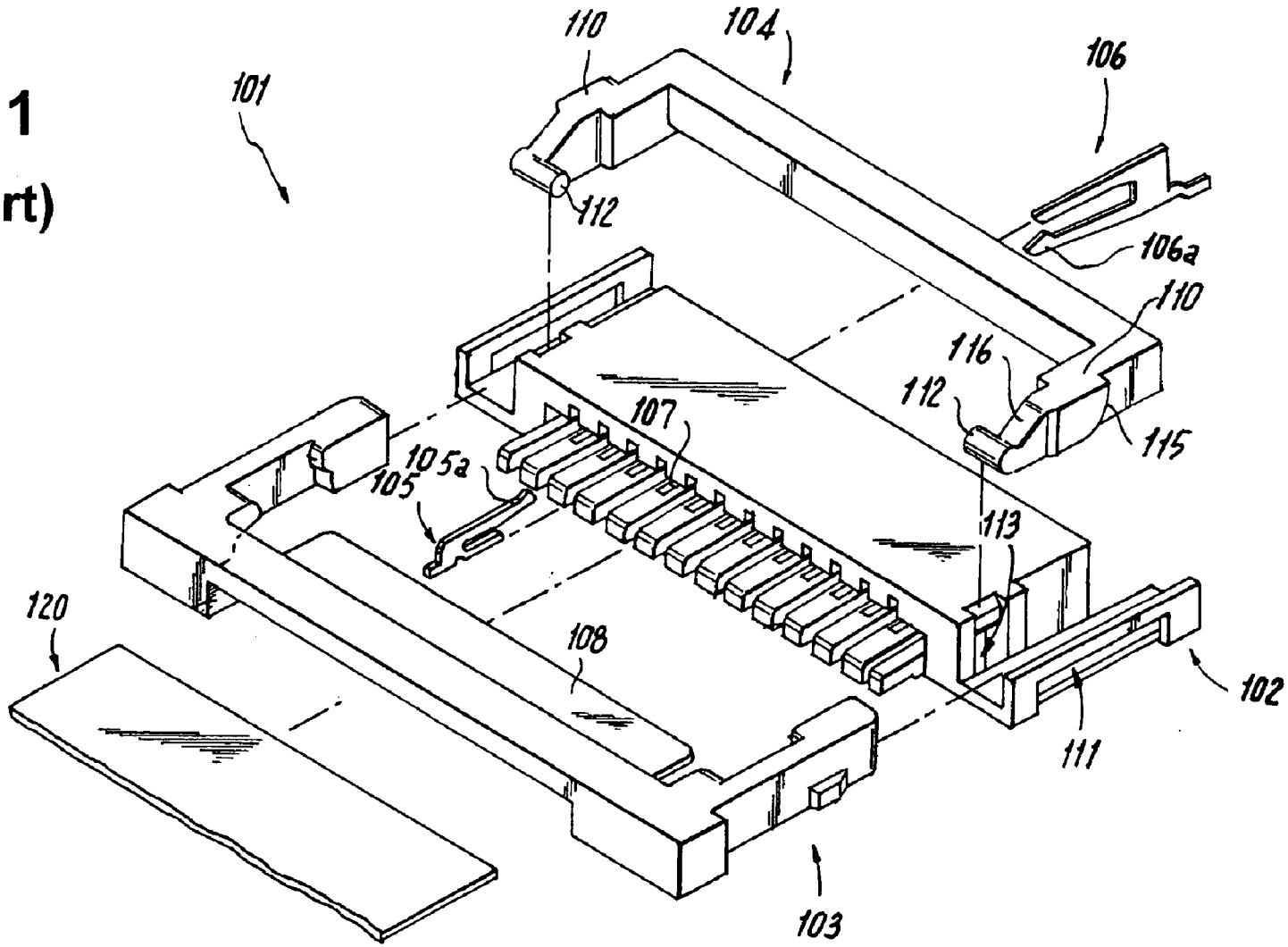
Fig. 11 (Prior Art)
FIG. 11 is a perspective view of the prior art.

A flexible substrate connector 1 includes a housing 2, a slider 3, an operation lever 4, and multiple contacts 5, 6, as shown in FIGS. 1(*a*)–(*f*), and FIGS. 2(*a*) and (*b*). The contacts 5, 6 include contact points 51, 61, respectively. The connector 1 establishes an electrical connection between an element such as a printed circuit board and a flexible substrate 8 such as a FFC or FPC.

The flexible substrate 8 has a substantially flat shape, and multiple contact terminals are located on an edge of the flexible substrate 8. These contact terminals allow the flexible substrate 8 to connect electrically with contacts 5, 6.

The housing 2 includes a body 21, an insertion opening 22, and guides 7. The flat, rectangular body 21 is formed from a dielectric plastic resin. The insertion opening 22 is a recessed widthwise slit on the front surface of the body 21, and the flexible substrate 8 is inserted into the insertion opening 22 in the body 21 during operation. A guide 7 is located on each side of the body 21.

The slider 3 includes two slide arms 32 and moves relative to the housing 2. The operation lever 4 includes turn arms 42 that control and connect to the slider 3. The slider 3 moves between a backward position A and a forward position B.

The housing 2 includes multiple positioning slits 23, 24 which are recessed corresponding to an arrangement of conductor patterns on the flexible substrate 8, as shown in FIGS. 3(*a*)–(*e*). The positioning slits 23, 24 position contacts 5,6 provided on the top and bottom inner wall surfaces that face the insertion opening 22 of the body 21. The positioning slits 23 open on the front side of housing 2 in a backward manner in order to position and support the contacts 5, and likewise, the positioning slits 24 open on the rear side of housing 2 in a frontward manner in order to position and support the contacts 6. Since the positioning slits 23, 24 support contacts 5, 6, respectively, contact points 51, 61 are exposed in two front and rear rows on the bottom surface of insertion opening 22.

Locks 25 protrude forward from both of the side surfaces of the housing body 21. During the locking operation, the locks 25 secure the operation lever 4 when the slider 3 is in the forward position. As a result, minor external forces such as vibrations cannot alter the relative position of the operation lever 4 and the housing 2.

The guides 7 are fixed to both of the left and right side surfaces of the housing body 21 and are formed by bending a solderable metal plate into a substantially U-shaped section form that opens upward, as shown in FIGS. 4(*a*)–(*d*). Each guide 7 includes an outer wall 71 and an installation wall 72 that comprise the pair of opposing walls of the U-shaped form. The guides 7 extend continuously on both sides of the housing body 21. During operation, each of the slide arms 32 is located between the outer wall 7 and the installation wall 72 of the respective guides 7. The slide arms 32 slide in the forward or rearward direction within the guides 7. The turn arms 42 of the operation lever 4 are located between the outer walls 71 of the respective guides 7 and the housing body 21.

Each guide 7 includes a guide groove 73 that extends through the outer wall 71 of the guide 7 and is oriented lengthwise in the front-rear direction. During assembly and operation, the guide groove 73 guides and loosely engages a locking protrusion 33 that protrudes outward from the middle portion of the outer surface of each slide arm 32 of the slider 3. During forward and backward movement of the slider 3, the guide grooves 73 maintain the alignment of the slider 3 relative to the housing 2. The slider 3 is able to slide while the locking protrusions 33 are locked in the respective guide grooves 73 in order to prevent the slider 3 from detaching when moving to the backward position.

Pivot-supporting holes 74 are provided through the installation walls 72 of the guides 7 backward of the housing body 21. The operation lever 4 is supported turnably at the pivot-supporting holes 74 which are loosely engaged with the pivots 46 which protrude toward the inside at the end of the turn arms 42. The pivot-supporting holes 74 are reinforced and can withstand repeated operation and stress since the pivot-supporting holes 74 are preferably formed in metal guides 7. This design prevents damage to the area surrounding the pivot-supporting holes 74. The guides 7 can be formed so that the left and right side walls of the housing body 21 serve as the installation walls 72, and the outer walls 71 opposing to the installation walls 72 are formed integrally with the housing body 21 by the same material.

A rod-like slider body 31 on the slider 3 extends widthwise over the front side of housing 2 and joins the ends of slide arms 32 which face each other, as shown in FIGS. 5(*a*)–(*f*). The slide arms 32 are stored slidably between the outer walls 71 and the installation walls 72 of the guides 7. A rectangular press plate 34 extends parallel to the slider body 31 between the slide arms 32 and protrudes from the middle part of the slider body 31 in a forward direction.

The slider 3 is formed from dielectric plastic resin. As the slider 3 moves relative to the housing 2 and the slide arms 32 slide along the respective guides 7, the press plate 34 enters or retracts from the insertion opening 22. Since the press plate 34 is inserted into the insertion opening 22, the top surface of the flexible substrate 8 inserted into the insertion opening 22 is pressed toward the contact points 51, 61 of contacts 5, 6, respectively. The thickness of the press plate 34 is used to adjust the amount of the deflection, namely the contact pressure, of contacts 5, 6.

During the insertion operation, the flexible substrate 8 is inserted without force into the insertion opening 22 while slider 3 is in the backward position A, and the press plate 34 is moved away from the insertion opening 22. In this position, the operation lever 4 is raised, and the flexible substrate 8 covers the press plate 34. After the flexible substrate 8 is fully inserted into the insertion opening 22, the operation lever 4 is operated, and slider 3 moves to the forward position B adjacent to the housing 2. While the slider 3 returns to the forward position B, the press plate 34 enters the insertion opening 22 and elastically and uniformly urges the flexible substrate 8 into electrical contact with the contact points 51, 61 on contacts 5, 6.

The locking protrusions 33 are loosely engaged with the guide groove 73 and integrally protrude from the middle part on the outside of the slide arms 32. In the backward position of the slider 3, the locking protrusions 33 contact the backward end of the guide grooves 73. Since a top and bottom surface of each guide groove 73 contacts a respective top and bottom surface of each locking protrusion, slider 3 is smoothly guided throughout operation and slider 3 cannot move relative in an up or down direction.

Recesses 35 are positioned respectively on the inner sides of the slide arms 32 and engage the turn arms 42 of the operation lever 4. The recesses 35 include inner wall surfaces opposing to each other in the forward/backward direction. A top part of both of the walls forms a protruding curved surface. A forward wall surface of each recess 35 forms a forward follower surface 36, and a backward wall surface of each recess 35 forms a backward follower surface 37.

When the slide arms 32 of the slider 3 are positioned in the guides 7, the guides 7 guide the slide arms 32 in the forward/backward direction, and the press plate 34 can be inserted freely into the insertion opening 22. Thus, the slider 3 travels between the backward position A where the press plate 34 is pulled out from the insertion opening 22, and the forward position B where the press plate 34 is inserted into the insertion opening 22.

The operation lever 4 is preferably made of dielectric plastic resin or metal and is formed in a general U-shape with an operation part 41 joining turn arms 42, as shown in FIGS. 6(*a*)–(*c*) and 7(*a*)–(*e*). The operation part 41 is formed into a rod shape extending in the widthwise direction. The pair of opposing turn arms 42 includes opposing pivots 46 and loosely engages respective pivot-supporting holes 74 in guides 7. The body 21 of the housing 2 is provided between the pair of turn arms 42, and the pivots 46 are loosely engaged to turn freely on the pivot-supporting holes 74 provided on the guides 7 of the housing 2. The operation lever 4 turns about the pivots 46 with respect to the housing 2. An outer surface of each turn arm 42 expands at the middle and forms a forward cam surface 43. The forward cam surface 43 has an arc-shape and contacts the forward follower surface 36 during operation when the slider 3 is attached to the housing 2. A backward cam surface 44 is formed on each turn arm 42 and contacts the backward follower surface 37 during operation. The backward cam surface 44 is a slope surface rising gently toward the operation part 41 toward a tip of the turn arm 42. When the turn arms 42 are attached to the housing 2 during assembly, the turn arms 42 fit into the recesses 35 of the slider 3. Thus, the forward cam surface 43 and the backward cam surface 44 oppose the forward follower surface 36 and the backward follower surface 37, respectively.

A turn lock 45 is provided on each inner side surface of the turn arms 42 of the operation part 41 in the operation lever 4. The turn locks 45 protrude at a position opposing the locks 25 on the housing 2. In the locked state, the turn locks 45 engage the opposing locks 25 when the slider 3 and the operation lever 4 are in the forward position B. The lock cannot be released easily. The turn locks 45 on the operation part 41 and the locks 25 on the housing 2 are protruded in this embodiment. However, either one of them may protrude while the other may be recessed in a groove shape so that they may be locked to each other.

The two types of contacts 5 and 6 are formed by forming an elastic conductive metal plate, such as a copper alloy plate, into a two-branch fork shape. The tip of a top piece of the fork of the contact 5 forms the contact point 51, and a bottom piece forms an installation part 52 which is pressed into the positioning slit 23 in the housing body 21. The contact point 51 protrudes forward from a bottom surface in the insertion opening 22 and is fixed to the housing body 21, and the contact is supported at one side. Likewise, the tip of a top piece of the fork in the contact 6 forms the contact point 61, and the bottom piece forms an installation part 62 which is pressed into the positioning slit 24. The contact point 61 protrudes backward from a bottom surface in the insertion opening 22, and the contact 6 is supported at one side.

The contacts 5, 6 are provided so that the bases of the respective forks are exposed parallel to the bottom surface of the housing body 21. Thus, the bases are soldered to, and thereby connected with, land patterns (not shown) located at positions corresponding to the bases of contacts 5, 6 on the printed circuit board. The contacts 5, 6 are provided at equal intervals in the widthwise direction at the forward and backward positions, respectively. When the contacts 5, 6 are provided in this way, the bases of the contacts 5 are arranged parallel to the bases of the contacts 6. The contacts 5 are shifted by half an interval in the widthwise direction from the contacts 6. The individual contacts 5, 6 are soldered in this arrangement and are connected electrically to the land patterns printed on a printed circuit board.

The slider is moved to the backward position A before the flexible substrate 8 can be inserted into the connector 1. The operation lever 4 is turned until it is tilting upward with respect to the housing 2 as shown in FIG. 7(*a*). The slider 3 moves to the backward position A after moving the operation lever 4 in this manner. In the backward position A, the slider 3 forms a gap into which the flexible substrate 8 can be inserted in the insertion opening 22 of the connector 1.

The slider 3 slides backward when the backward cam surfaces 44 of the operation lever 4 contact the backward follower surfaces 37 of the slider 3. The slider 3 stops when a pressure angle between the backward cam surface 44 and the backward follower surface 37 increases or when the locking protrusions 33 contact the backward end of the guide groove 73. When the slider 3 stops at this backward position, the press plate 34 can be extracted from the insertion opening 22, and a gap is formed for inserting the flexible substrate 8.

The press plate 34 is not inserted into the insertion opening 22 in this standby state. Therefore, there is a space wider than the thickness of the flexible substrate 8 between the contact points 51, 61 of contacts 5, 6 and the opposing inner wall surface of the insertion opening 22 of the housing 2. The flexible substrate 8 can be inserted into the insertion opening 22 without interference from contacts 5, 6.

The flexible substrate 8 is inserted into the insertion opening 22 and into the gaps between the contact points 51 and the installation part 52 of contacts 5 and between the contact point 61 and the installation part 62 of contacts 6. Thus, the flexible substrate 8 can be inserted by a small insertion force.

The operation lever 4 is turned about the pivots 46 so that the slider 3 moves into the forward position B, as shown in FIG. 7(*b*). The forward cam surfaces 43 of the operation lever 4 contact the forward follower surfaces 36 of the slider 3. The locking protrusions 33 on the slide arms 32 move in the guide grooves 73 of the guides 7 so that the slider 3 slides while being guided by the guides 7.

In the forward position B, the protruding locks 25 located on each side of the housing 2 engage with the respective turn locks 45 on the operation lever 4. When the locks engage with each other, the operator experiences a 'snap-type' feedback to confirm the locked state between the housing 2 and the operation lever 4.

The operation lever 4 can be turned forward until it is parallel to the slider 3 as shown in FIG. 7(*c*). The press plate 34 of the slider 3 is inserted into the insertion opening 22 until the press plate 34 reaches the forward position B. The operation lever 4 is parallel to the housing 2 when the slider 3 is at the forward position B. Thus, the turn locks 45 of the operation lever 4 are engaged with the locks 25 of the housing 2.

In the locked state, the flexible substrate 8 is pressed toward the contact points 51, 61 of contacts 5, 6 by the press plate 34 which is inserted into the gap in the insertion opening 22. Therefore, the contact points 51, 61 bend downward to apply a predetermined contact pressure elastically on the conductor patterns on the flexible substrate 8. The contact pressure ensures a secure electrical connection.

The flexible substrate 8 cannot be disconnected from contacts 5, 6 or extracted unintentionally if the press plate 34 is in close contact with the top surface of the flexible substrate 8. The forward cam surfaces 43 of the operation lever 4 restrict the backward movement of the slider 3. Additionally, the movement of the operation lever 4 is prevented when the turn locks 45 are engaged with the locks 25 on the housing 2.

The flexible substrate 8 is disconnected from contacts 5, 6 when the flexible substrate 8 is extracted intentionally. The operation part 41 of the operation lever 4 is turned upward so that the turn locks 45 and the locks 25 are unlocked as shown in FIG. 7(*d*), and then, the operation part 41 is turned backward as shown in FIG. 7(*e*). The slider 3 slides to the backward position A in the standby state.

The press plate 34 is extracted from the insertion opening 22 when the press plate 34 returns to the standby state. The contact points 51, 61 of contacts 5, 6 cease to bend downward since the downward pressure on the contact points 51, 61 and the contact pressure on the conductor patterns on the flexible substrate 8 are released. The flexible substrate 8 may be extracted since the contact pressure on the conductor patterns on the flexible substrate 8 is released. The force required for the extraction is reduced.

A cam mechanism comprises plate cams 43 and 44 which are formed on the operation lever 4 and act as follower surfaces to the slider 3. However, other mechanisms such as a link mechanism may be used when the turning motion of the operation lever 4 is converted into the reciprocate linear motion of the slider 3. Additionally, the cam mechanism may comprise other components such as a spatial cam that includes a groove cam that engages with a pin.

The press plate 34 of the slider 3 may be inserted between the elastically deformed contacts 5,6 and the housing 2 so that the slider 3 presses the flexible substrate 8 toward contacts 5, 6 to establish a connection between contacts 5,6 and the flexible substrate 8.

Although the housing 2 of the present invention may include two types of contacts 5, 6, the flexible substrate 8 can contact any number of different types of contacts.

The areas surrounding the pivot-supporting holes 74 are reinforced sufficiently since the guides 7 are preferably formed with a metal plate. The connector 1 is more durable. Additionally, it is not necessary to provide separate parts to solder to a printed circuit board when the connector needs to be fixed since the guides are used for soldering. Therefore, the size and number of parts in the connector are reduced.

Secure contact is established between contacts 5,6 and the flexible substrate 8 when the turn locks on the operation lever 4 and the locks provided on the housing are locked. Additionally, the operation lever can be prevented from moving unintentionally by external forces such as vibrations when the flexible substrate is in contact with the contacts since the connection between the contacts and the flexible substrate is secure.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A connector for connecting to a flexible substrate, said connector comprising:

a housing comprising a pair of first and second side surfaces opposite to each other; pivot-supporting holes in said first and said second side surfaces; guides on said first and said second side surfaces bending outward in an L-shape from said first and said second side surfaces; guide grooves on a surface of said guides; an insertion opening on a third side surface of said housing; and locks on a fourth side surface of said housing opposite to said third side surface;

multiple contacts attached to the housing, said multiple contacts comprising contact points at predetermined intervals in said insertion opening and positioned to contact conductor patterns on said flexible substrate;

a U-shaped slider comprising slide arms opposite said U-shape and guided by said guides of said housing and a press plate on an other part of said U-shape and inserted into said insertion opening, said slider being capable of traveling freely between a backward position and a forward position, said backward position being where said press plate is out from said insertion opening and forms a gap for inserting said flexible substrate into said insertion opening, said forward position being where said press plate is inserted into said insertion opening and being capable of pressing either one of said contact points of said contacts and said flexible substrate against the other; and an operation lever comprising opposing turn arms; pivots protruding from said turn arms and engaged turnably with said pivot-supporting holes on said guides; and an operation part connecting said turn arms with each other, said turn arms comprising turn locks for locking to the locks on said housing, said operation lever being supported turnably with respect to said housing, said operation lever moving said slider forward and backward in association with a turn, wherein guide protrusions of said slider slide between said forward position and said backward position in said guide grooves of said guides when said operation lever is turned, and said connector being adapted so that said flexible substrate can be inserted into said insertion opening when said slider is positioned at said backward position, and said contact points of said multiple contacts and said conductor patterns of said flexible substrate inserted into said insertion opening elastically come in contact with each other, and said connector being adapted so that said turn locks provided on said operation lever and said locks provided on said housing are locked to each other when said slider moves to said forward position.

2. A connector for connecting with a flexible substrate, said connector comprising:

guides comprising a U-shape section metal plate, a pivot-supporting hole through a first surface of said guide, and an oblong guide groove through a second surface of said guide, said second surface of said guide opposing said first surface of said guide;

a housing comprising a pair of side surfaces for fixing said first surface of said guides and a side surface having an insertion opening recessed adapted for inserting a flexible substrate;

multiple contacts attached to the housing, said multiple contacts comprising contact points at a predetermine interval in said insertion opening and adapted to contact conductor patterns on said flexible substrate;

a U-shaped slider comprising opposing slide arms in said U-shape of said slider and guided by said guides and a press plate in said U-shape of said slider and inserted into said insertion opening;

said slider traveling freely between a backward position and a forward position, said backward position being where said press plate is pulled out from said insertion opening to form a gap for inserting said flexible substrate into said insertion opening, said forward position being where said press plate is inserted into said insertion opening and any of said contact points of said contacts and said flexible substrate can be pressed against the other; and an operation lever comprising opposing turn arms and pivots protruding from said turn arms and engaged turnably with said pivot-supporting holes on said guides, said operation lever being supported turnably by said housing, said operation lever moving said slider forward and backward in association with said turn;

wherein guide protrusions of said slider slide between said forward position and said backward position in said guide grooves when said operation lever is turned;

said connector being adapted so that said flexible substrate can be inserted into said insertion opening when said slider is positioned at said backward position and said contact points of said contacts and said conductor patterns of said flexible substrate inserted into said insertion opening elastically contact each other when said slider moves to said forward position.

* * * * *